US009333737B1

(12) United States Patent
Porat et al.

(10) Patent No.: US 9,333,737 B1
(45) Date of Patent: May 10, 2016

(54) METHODS OF PREPARING LITHOGRAPHIC PRINTING MEMBERS BY IMAGEWISE DEPOSITION AND PRECURSORS SUITABLE THEREFOR

(71) Applicants: Aida Porat, Shlomi (IL); Michael Karp, Petah Tiqwa (IL); Ehud Shchori, Rehovot (IL)

(72) Inventors: Aida Porat, Shlomi (IL); Michael Karp, Petah Tiqwa (IL); Ehud Shchori, Rehovot (IL)

(73) Assignee: VIM Technologies, Inc., Kibbutz Hanita (IL)

( * ) Notice: Subject to any disclaimer, the term of this patent is extended or adjusted under 35 U.S.C. 154(b) by 152 days.

(21) Appl. No.: 14/082,963

(22) Filed: Nov. 18, 2013

Related U.S. Application Data

(60) Provisional application No. 61/732,714, filed on Dec. 3, 2012.

(51) Int. Cl.

| | |
|---|---|
| ***B41M 1/06*** | (2006.01) |
| ***B41C 1/10*** | (2006.01) |
| *B41J 2/01* | (2006.01) |

(52) U.S. Cl.
CPC ..... *B41C 1/1025* (2013.01); *B41C 1/1066* (2013.01); *B41M 1/06* (2013.01); *B41J 2/01* (2013.01)

(58) Field of Classification Search
None
See application file for complete search history.

(56) References Cited

U.S. PATENT DOCUMENTS

| | | | | |
|---|---|---|---|---|
| 4,833,486 | A | 5/1989 | Zerillo | |
| 5,312,654 | A | 5/1994 | Arimatsu et al. | |
| 5,495,803 | A | 3/1996 | Gerber et al. | |
| 5,511,477 | A | 4/1996 | Adler et al. | |
| 5,738,013 | A | 4/1998 | Kellett | |
| 5,820,932 | A | 10/1998 | Hallman et al. | |
| 6,184,267 | B1 | 2/2001 | Kato et al. | |
| 6,455,132 | B1 | 9/2002 | Aurenty et al. | |
| 6,620,469 | B2 * | 9/2003 | Totani | B41M 5/506 428/32.1 |
| 6,758,140 | B1 | 7/2004 | Szumla et al. | |
| 7,044,053 | B2 | 5/2006 | Figov et al. | |
| 8,062,720 | B1 | 11/2011 | Porat et al. | |
| 2004/0051768 | A1 | 3/2004 | DeBoer et al. | |
| 2004/0125188 | A1 * | 7/2004 | Szumla | B41C 1/1066 347/103 |
| 2006/0107859 | A1 * | 5/2006 | Sampei | B41C 1/1025 101/453 |
| 2006/0223006 | A1 | 10/2006 | Shimada et al. | |
| 2008/0241738 | A1 * | 10/2008 | Maemoto | B41C 1/1066 430/270.1 |
| 2008/0299363 | A1 * | 12/2008 | Bhatt | B41C 1/1066 428/211.1 |

FOREIGN PATENT DOCUMENTS

| | | | |
|---|---|---|---|
| EP | 1157825 | A1 | 11/2001 |
| JP | 56105960 | | 8/1981 |

* cited by examiner

*Primary Examiner* — Joshua D Zimmerman
(74) *Attorney, Agent, or Firm* — Morgan, Lewis & Bockius LLP

(57) ABSTRACT

A lithographic precursor includes a hydrophilic layer that presents a surface for lithographic interaction, and which is formulated to receive a pigment-based aqueous ink deposited (e.g., by inkjet) in an "imagewise" pattern. The compatibility between the ink and the hydrophilic layer is such that a baking step is not required for subsequent printing.

16 Claims, 1 Drawing Sheet

METHODS OF PREPARING LITHOGRAPHIC PRINTING MEMBERS BY IMAGEWISE DEPOSITION AND PRECURSORS SUITABLE THEREFOR

CROSS-REFERENCE TO RELATED APPLICATION

This application claims priority to, and the benefits of, U.S. Ser. No. 61/732,714, filed on Dec. 3, 2012, the entire disclosure of which is hereby incorporated by reference.

FIELD OF THE INVENTION

The present invention relates to lithographic printing members and their manufacture, and in particular to lithographic printing members produced by deposition of ink-accepting material onto a hydrophilic carrier.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include deposition systems that apply a high-resolution pattern of image "spots" onto a carrier. The image spots have a lithographic affinity different from that of the carrier—e.g., oleophilic image spots are applied onto a hydrophilic carrier in a wet lithographic system. Inkjet deposition equipment is often used apply the image spots due to its precision, ability to eject small droplets consistent in size with commercial printing resolutions, and amenability to computer control. The inkjet fluid may interact chemically with the hydrophilic layer or, instead, may simply adhere to it. Indeed, in the latter case, the inkjet fluid may be ink that is baked into hardness following deposition.

Ink deposition systems thus avoid the need for specialized process fluids as well as environmentally detrimental chemical development. The baking step, however, may require high temperatures (130-150° C. is not uncommon) and necessitate special equipment, all of which add cost and time.

SUMMARY OF THE INVENTION

In accordance with embodiments of the present invention, a lithographic precursor includes a hydrophilic layer that presents a surface for lithographic interaction, and which is formulated to receive a pigment-based aqueous ink deposited (e.g., by inkjet) in an "imagewise" pattern. The compatibility between the ink and the hydrophilic layer is such that a baking step is not required for subsequent printing. In various embodiments, the hydrophilic layer comprises or consists essentially of a hydrophilic polymer matrix, acidic colloidal silica, a strong acid, and polyvalent metal ions. The imaged printing member may be installed on-press immediately after it is imaged. According to some embodiments of the present invention, the imaged printing member may be a lithographic printing plate suitable for conventional wet printing systems.

Accordingly, in a first aspect, the invention relates to a method of producing and printing with a lithographic printing member. In various embodiments, the method comprises providing a precursor comprising (i) a substrate and (ii) a cured polymeric hydrophilic layer thereover. The hydrophilic layer comprises acidic colloidal silica, a strong acid and polyvalent metal ions. The method further comprises depositing, on the precursor, an imagewise pattern of a pigment-based aqueous ink to form a finished lithographic printing member, and printing with the printing member by sequentially applying thereto an aqueous fountain solution followed by ink. The ink adheres only to the imagewise pattern, and the applied ink is transferred to a recording medium.

An advantage of the invention is that the printing member may not be baked prior to the printing step. However, printing members in accordance herewith can withstand baking if desired. In some embodiments, the printing member is baked (e.g., heated at about 150° C. for about 5 min.), and after this it may be capable of printing more impressions than without baking. The method may include, prior to the printing step, wiping the lithographic printing member with a water solution of a salt of the polyvalent metal; it is found that this step, too, may increase the number of printable impressions.

In various embodiments, the colloidal silica comprises or consists of elongated particles. For example, the elongated particles may have a length in the range of 30 nm to 1000 nm and a ratio between a short dimension and a long dimension in the range of 3 and 20. The colloidal silica may constitute more than 10% by weight of the cured hydrophilic layer.

The strong acid may comprise or consist of one or more of sulfuric acid, hydrochloric acid, nitric acid, hydrobromic acid, hydroiodic acid, perchloric acid, p-toluenesulforic acid, trifluoroaceticacid, or trichloroacetic acid. The polyvalent metal may be, for example, aluminum, and in some embodiments, the aluminum is in the form of a salt—e.g., one or more of aluminum chloride, aluminum nitrate, or aluminum sulfate. In other embodiments, the aluminum is supplied by addition to the layer of dispersed or colloidal alumina, or the substrate may be aluminum so as to supply the aluminum to the polymeric hydrophilic layer. In other embodiments, the polyvalent metal is zirconium—e.g., in the form of zirconium (IV) chloride.

In various embodiments, the hydrophilic layer comprises one or more of poly(vinyl alcohol), poly(vinyl pyrrolidone), polyethyl oxazoline, poly(acrylic acid), polyacrylamide, copolymers of the above vinyl polymers, polyethylenglycol, gum arabic, hydroxyethyl cellulose, hydroxypropyl cellulose, or polyethylenimine. The precursor may also further comprise a primer layer over the substrate.

In another aspect, the invention relates to a lithographic precursor comprising, in various embodiments, a substrate and a cured polymeric hydrophilic layer thereover, where the hydrophilic layer comprises acidic colloidal silica, a strong acid and polyvalent metal ions. Various embodiments may include any, some or all of the features set forth above in connection with the precursor.

It should be stressed that, as used herein, the terms "printing member" and "printing plate" are used interchangeably refer to any type of printing member or surface capable of recording an image defined by regions exhibiting differential affinities for ink. Suitable configurations include the traditional planar or curved lithographic plates that are mounted on the plate cylinder of a printing press, but can also include seamless cylinders (e.g., the roll surface of a plate cylinder), an endless belt, or other arrangement.

The term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. The term "oleophilic" is used in the printing sense to connote the affinity of a surface for ink to adhere thereto.

The term "fountain solution," as used herein, pertains to a solution used to clean or remove the water-soluble portions of the imaged printing members of the methods of this invention and may be water, combinations of at least 90% water and 10% or less organic solvents and additives such as alcohols, surfactants, and glycols, and buffered or salt-containing neutral or nearly neutral water solutions.

The term "inkjet" refers to any form of deposition that can be used to apply an imagewise pattern by propelling droplets of a liquid onto a lithographic surface. The only requirement is a droplet size sufficiently small to be consistent with a desired printing resolution.

The terms "substantially" and "approximately" mean±10% (e.g., by weight or by volume), and in some embodiments, ±5%. The term "consists essentially of" means excluding other materials that contribute to function or structure. Percentages refer to weight percentages unless otherwise indicated.

DESCRIPTION OF DRAWING

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanying drawings, in which:

Figure 1:
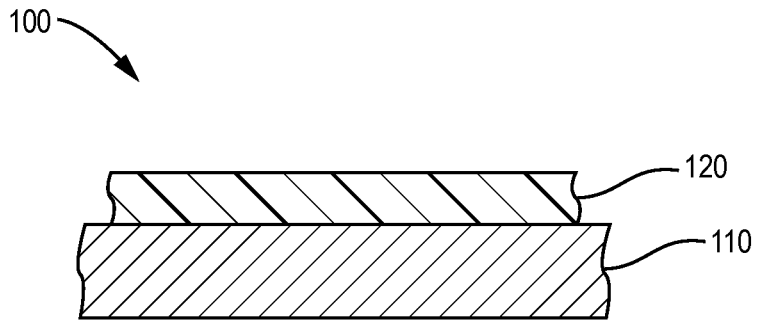
FIG. 1 illustrates an enlarged sectional view of an embodiment of a wet printing member according to an embodiment of the invention.

It will be appreciated that for simplicity and clarity of illustration, elements shown in the figure have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

Refer first to FIG. 1, which illustrates a printing member 100 in accordance herewith. The printing member 100 includes a substrate 110 and a hydrophilic, polymeric coating layer 120 thereover.

Figure 2:
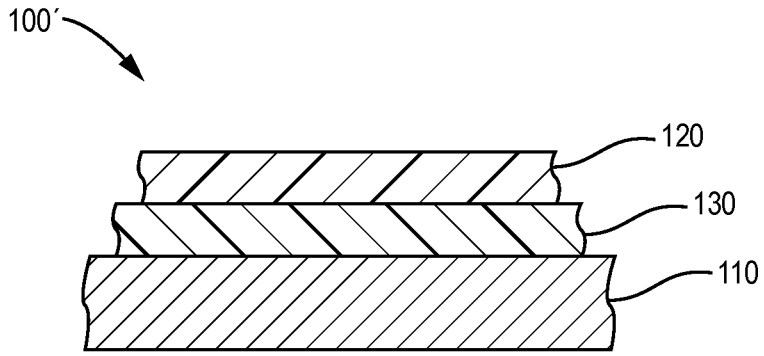
FIG. 2 illustrates an enlarged sectional view of an embodiment of a wet printing member including a primer layer.

The substrate 110 provides dimensionally stable mechanical support to the printing member. Suitable substrate materials include, but are not limited to, metals, polymers (e.g., polyethylene terephthalate, or PET), and paper. In various embodiments, substrate 110 may be aluminum—e.g., a grained aluminum sheet having a thickness in the range of 100 μm to 1000 μm. Optionally, as shown in FIG. 2, a primer layer 130 may be added between substrate 110 and hydrophilic coating layer 120 to improve inter-layer adhesion. The primer layer 130 may include or consist essentially of a terpolymer. Non-limiting examples of terpolymers include vinyl chloride, vinyl alcohol, vinyl acetate, vinyl butyral, maleic anhydride, and any combination thereof. The primer layer may also include a matting agent, such as amorphous silica, alumina and/or kaolin.

Hydrophilic coating layer 120 may be applied to substrate 110 using any suitable method known in the art—for example, wire-wound rod coating, roll coating, spin coating or extrusion hopper coating. The hydrophilic coating layer 120 may include a mixture of acidic colloidal silica (e.g., ranging from 2 to 4), a hydrophilic polymer such as polyvinyl alcohol, a strong acid (e.g., having a $pK_a$ value less than zero) such as sulfuric acid and ions of one or more polyvalent metals such as aluminum. The amount of acidic colloidal silica in the coating mixture may vary from about 10% by weight to about 45% by weight. The amount of hydrophilic polymer in the coating mixture may vary from about 15% by weight to about 30% by weight. The amount of strong acid may vary from 0.05% by weight to about 2% by weight. The amount of polyvalent metal ions may vary from 0.05% by weight to about 5% by weight.

Coating layer 120 may further include a cross-linking agent such as glyoxal, glutaraldehyde and/or melamine-formaldehyde resin. The amount of cross-linking agent, if present in the coating layer, may vary from about 0.1% by weight to about 20% by weight. In other embodiments, however, coating layer 120 self-cures. The coating layer may also include a matting agent to increase the roughness of the coating and therefore aid in the absorption of water used in wet lithographic systems. The matting agent may be in particulate form, with particle diameters ranging from approximately 1 to approximately 20 μm. Matting agents such as amorphous silica, alumina and/or kaolin may be used. Other materials, such as dyes and pigments, may be added to the coating layer 120.

In certain embodiments of the invention, the acidic colloidal silica used in the coating layer is in the form of particles with elongated shape. The elongated particles may have a length ranging from 30 nm to 1000 nm. In particular, the shape of the elongated particles may be such that the ratio between a short (diameter) and long (length) dimension of a particle varies between approximately 3 and approximately 20. For, example, according to embodiments of the invention, the elongated particles have a diameter of 9-15 nm with a length of 40-100 nm. In other embodiments, the colloidal silica particles have a different shape, e.g., a string-of-pearls form. The pH of the elongated colloidal silica may be in the range of 2 to 4.

The hydrophilic polymer may be a polyvinyl alcohol or one its derivatives. A non-exhaustive list of suitable hydrophilic polymers includes poly(vinyl alcohol), poly(vinyl pyrrolidone), polyethyl oxazoline, poly(acrylic acid), polyacrylamide, copolymers of the above vinyl polymers, polyethylenglycol, gum arabic, hydroxyethyl cellulose, hydroxypropyl cellulose and polyethylenimine, which may be used alone or in combination. The amount of hydrophilic polymer in the coating mixture may vary from about 15% by weight to about 30% by weight.

The strong acid may be sulfuric acid and/or one or more of hydrochloric acid, nitric acid, hydrobromic acid, hydroiodic acid, perchloric acid, p-toluenesulforic acid, trifluoroaceticacid, or trichloroacetic acid. The amount of strong acid may vary from 0.05% by weight to about 2% by weight.

The polyvalent ion may be aluminum, though ions of other polyvalent metals, such as zirconium, can be used. Polyvalent ions may be incorporated by addition to the coating formulation of the metal salts such as aluminum chloride, zirconium (IV) chloride, aluminum nitrate, aluminum sulfate, etc. Alternatively, polyvalent ions may be incorporated by addition to the coating of a dispersed or colloidal ion source such as alumina; in a strong acid environment, aluminum ions may be formed from the alumina and distributed into the coating mixture. Another suitable source of aluminum ions, in particular, is an anodized aluminum substrate 110. The strong acid of the coating mixture may react with the aluminum substrate during the coating process, forming aluminum ions in the mixture prior to drying and cross-linking of the coating layer. The amount of polyvalent metal ions may vary from 0.05% by weight to about 5% by weight.

An imaging apparatus suitable for use in conjunction with the present printing members uses or is based on an inkjet printer. To facilitate accurate imaging of printing members, the paper-handling or substrate-handling subsystem of the inkjet printer should have a short, straight paper path. Inkjet printing involves projecting tiny drops of ink fluid directly onto the plate surface without physical contact between the inkjet printer and the plate. The inkjet printer stores electrical data corresponding to the image to be printed (specifically, the image or background area, depending on whether the plate is positive-working or negative-working—in the present case, the image area), and controls a mechanism for ejecting ink droplets imagewise onto the plate. Printing is performed by moving the print head across the plate or vice versa.

There are generally two mechanisms that commercially available inkjet printers utilize to control how ink droplets are jetted. In continuous inkjet printing, the print head propels a continuous stream of ink through a nozzle. This stream is broken down into identical droplets, which are then selectively charged. Depending on the construction of the printer, either the charged or the uncharged droplets are deflected and guided towards the receiving medium. The undeflected droplets are collected and recycled. Continuous inkjet printers require complex hardware, but they offer high-speed printing as an advantage.

In drop-on-demand inkjet printers, ink droplets are generated and ejected through the orifices of the print head only as needed. Some drop-on-demand systems use a thermal process to create the pressure required to eject ink droplets. These thermal jet (or bubble jet) printers use heat to generate vapor bubbles in a volatile component of the ink fluid. As these bubbles build up pressure and vaporize, ink droplets are jetted out of the print head one at a time. Other drop-on-demand systems utilize a piezoelectric actuator to eject ink droplets. In these printers, a computer signal imposes an electrical potential across a piezoelectric material which causes it to deform. Ink droplets are ejected as the piezoelectric material deforms and returns to its normal dimensions. Although drop-on-demand inkjet printers have relatively slow printing speed, they offer small drop size and highly controlled ink droplet placement.

The printing member 100 may be imaged by selectively depositing inkjet ink, such as water-based pigmented ink from a standard inkjet printer, on the cured coating 110. The imaged printing member can be installed on press and using for printing without the need for preliminary baking for fixation of the image. It should be noted, however, that the printing member can be baked if desired (e.g., heated at about 150° C. for about 5 min.) to increase printing durability (i.e., the number of impressions that can be printed by the printing member without image deterioration). It has been found that wiping the imaged printing member 100 with a water solution of the salt of the polyvalent metal used in the coating formulation also improves durability. The amount of salt in the water used for this purpose may vary from 0.5% by weight to about 20% by weight. The salt solution may also contain wetting agents, colorants and other additives.

EXAMPLES

The following are exemplary processes for the preparation of a printing member according to the present invention, which include preparing a printing member with an aluminum substrate or with a self supporting polymer substrate. In the following examples, component designations are in weight percentages.

Example 1

| Weight % | Ingredients of hydrophilic coating |
|---|---|
| 26.3 | 7% water solution of polyvinyl alcohol sold under the trade name CELVOL 165 by Celanese, Dallas, USA. |
| 30.72 | Colloidal silica, sold under the trade name SNOWTEX OUP by Nissan Chemical America Corporation, USA. |
| 7.98 | AERODISP WK 341 cationic stabilized silica in dispersed form of Evonic Industries, Germany |
| 0.17 | GASIL HP260 matting agent from PQ Corporation, USA. |
| 0.2 | Crosslinker sold under the trade name PROTOREZ R by Tanatex Chemicals, Netherlands. |
| 2.0 | Aluminum chloride ($AlCl_3 \cdot 6H_2O$) |
| 0.2 | Hydrocloric acid |
| 25.17 | Isopropyl alcohol (IPA) |
| b. t. w | Water |

The components set forth above were mixed and applied to a substrate using a roll-formed chrome-plated FT#35 from Buschman Corporation, Ohio, USA. The substrate was a PET film (SH92 clear antistatic-treated 175-μm PET film sold by SKC, Covington, USA). The coated film was then dried at 130° C. for 2 min. The hydrophilic coating was imaged by selectively applying an inkjet ink sold under the tradename T636200 Ultra Chrome HDR cyan inkjet ink by EPSON using an EPSON STYLUS PRO 7900 inkjet printer. The imaged plate was then mounted and printed on Heidelberg GTO-52 offset press. Using 142-126 Fountain solution from Prisco, Newark, USA and Rapida offset ink of Hostmann-Steinberg, Germany, 1000 impressions were successfully printed without preliminary baking.

Example 2

| Weight % | Ingredients of hydrophilic coating |
|---|---|
| 26.3 | 7% water solution of polyvinyl alcohol sold under the trade name CELVOL 165 by Celanese, Dallas, USA. |
| 30.72 | Colloidal silica sold under the trade name LudoxAM by Grace, Worms, Germany. |
| 7.98 | Aerodisp WK 341 cationic-stabilized silica in dispersed form from Evonic Industries, Germany |
| 0.17 | GASIL HP260 matting agent from PQ Corporation, USA. |
| 0.2 | Crosslinker sold under the trade name PROTOREZ R by Tanatex Chemicals, Netherlands. |

-continued

| Weight % | Ingredients of hydrophilic coating |
|---|---|
| 2.0 | Aluminum nitrate ($Al(NO_3)_3 \cdot 9H_2O$) |
| 0.2 | Sulfuric acid |
| 25.17 | Isopropyl alcohol (IPA) |
| b. t. w | Water |

The components were mixed and applied to a substrate as in Example 1, but the substrate was 150 mc grained and anodized aluminum, treated with sodium silicate in Verona Lastre, Italy. The hydrophilic coating was imaged by selectively applying an inkjet ink sold under the tradename T636200 Ultra Chrome HDR cyan inkjet ink by EPSON using an EPSON STYLUS PRO 7900 inkjet printer. The imaged plate was then mounted and printed on Heidelberg GTO-52 offset press. Using 142-126 Fountain solution from Prisco, Newark, USA and Rapida offset ink of Hostmann-Steinberg, Germany, 2000 impressions were successfully printed without preliminary baking and 20,000 impressions were successfully printed after baking at 150° C. for 2 min.

Example 3

A lithographic printing member was prepared and imaged as in Example 2. After imaging using the EPSON STYLUS PRO 7900 inkjet printer, the surface of the printing member was wiped with a water solution of aluminum nitrate, prepared according to the below table:

| Weight % | Ingredients of hydrophilic coating |
|---|---|
| 7 | Aluminum nitrate ($Al(NO_3)_3 \cdot 9H_2O$) |
| 0.15 | BYK-333 wetting agent, from BYK-Chemie, Germany |
| 0.15 | Violet Acosol Basico 10, by Acosol Basico, Spain, 0.3% solution in water |
| b. t. w | Water |

The imaged and wiped plate was then mounted and printed on Heidelberg GTO-52 offset press. Using 142-126 Fountain solution from Prisco, Newark, USA and Rapida offset ink from Hostmann-Steinberg, Germany, 5000 impressions were successfully printed without preliminary baking.

Although the present invention has been described with reference to specific details, it is not intended that such details should be regarded as limitations upon the scope of the invention, except as and to the extent that they are included in the accompanying claims.

What is claimed is:

1. A method of producing and printing with a lithographic printing member, the method comprising the steps of:

providing a precursor comprising (i) a substrate and (ii) a cured polymeric hydrophilic layer thereover, the hydrophilic layer comprising acidic colloidal silica, a strong acid and polyvalent metal ions, the strong acid being present in an amount of at least 0.05% by weight of the hydrophilic layer;

depositing, on the precursor, an imagewise pattern of a pigment-based aqueous ink to form a finished lithographic printing member; and printing with the printing member by sequentially applying thereto an aqueous fountain solution followed by ink, the ink adhering only to the imagewise pattern, and thereafter causing transfer of the applied ink to a recording medium.

2. The method of claim 1, wherein the printing member is not baked prior to the printing step.

3. The method of claim 1, wherein the colloidal silica comprises elongated particles.

4. The method of claim 3, wherein the elongated particles have a length within the range of 30 nm to 1000 nm and a ratio between a short dimension and a long dimension within the range of 3 and 20.

5. The method of claim 1, wherein the colloidal silica constitutes more than 10% by weight of the cured hydrophilic layer.

6. The method of claim 1, wherein the strong acid comprises one or more of sulfuric acid, hydrochloric acid, nitric acid, hydrobromic acid, hydroiodic acid, perchloric acid, p-toluenesulforic acid, trifluoroacetic acid, or trichloroacetic acid.

7. The method of claim 1, wherein the polyvalent metal is aluminum.

8. The method of claim 7, wherein the aluminum is in the form of a salt.

9. The method of claim 8, wherein the salt comprises at least one of aluminum chloride, aluminum nitrate, or aluminum sulfate.

10. The method of claim 7, wherein the aluminum is supplied by addition to the layer of dispersed or colloidal alumina.

11. The method of claim 7, wherein the substrate is aluminum and supplies the aluminum to the polymeric hydrophilic layer.

12. The method of claim 1, wherein the hydrophilic layer comprises one or more of poly(vinyl alcohol), poly(vinyl pyrrolidone), polyethyl oxazoline, poly(acrylic acid), polyacrylamide, copolymers of the above vinyl polymers, polyethylene glycol, gum arabic hydroxyethyl cellulose, hydroxypropyl cellulose, or polyethylenimine.

13. The method of claim 1, wherein the precursor further comprises a primer layer over the substrate.

14. The method of claim 1, further comprising, prior to the printing step, wiping the lithographic printing member with a water solution of a salt of the polyvalent metal.

15. The method of claim 1, wherein the polyvalent metal is zirconium in the form of zirconium (IV) chloride.

16. The method of claim 1, wherein the strong acid comprises one or more of nitric acid, hydrobromic acid, hydroiodic acid, perchloric acid, p-toluenesulforic acid, trifluoroacetic acid, or trichloroacetic acid.

* * * * *